US008696817B2

(12) United States Patent
Nord et al.

(10) Patent No.: US 8,696,817 B2
(45) Date of Patent: Apr. 15, 2014

(54) EQUIPMENT AND METHOD FOR REMOVING DEPOSITS CREATED IN ELECTROLYTIC REFINING

(75) Inventors: Peter Nord, Deje (SE); Rolf Andersson, Karlstad (SE)

(73) Assignee: Outotec Oyj, Espoo (FI)

( * ) Notice: Subject to any disclaimer, the term of this patent is extended or adjusted under 35 U.S.C. 154(b) by 1553 days.

(21) Appl. No.: 10/579,374

(22) PCT Filed: Nov. 26, 2004

(86) PCT No.: PCT/FI2004/000719

§ 371 (c)(1),
(2), (4) Date: May 12, 2006

(87) PCT Pub. No.: WO2005/054546

PCT Pub. Date: Jun. 16, 2005

(65) Prior Publication Data

US 2007/0125401 A1 Jun. 7, 2007

(30) Foreign Application Priority Data

Dec. 1, 2003 (FI) ..... 20031752

(51) Int. Cl.
*B08B 7/00* (2006.01)

(52) U.S. Cl.
USPC ..... 134/6; 15/3

(58) Field of Classification Search
USPC ..... 134/6, 22.1; 15/104.04
See application file for complete search history.

(56) References Cited

U.S. PATENT DOCUMENTS

| | | | | |
|---|---|---|---|---|
| 3,501,795 | A * | 3/1970 | Jasberg | 15/77 |
| 3,693,236 | A * | 9/1972 | Kapell et al. | 29/423 |
| 4,595,421 | A * | 6/1986 | Redhead et al. | 134/6 |
| 4,840,710 | A * | 6/1989 | Middlin et al. | 156/344 |
| 6,079,093 | A | 6/2000 | Segerström | |
| 6,814,847 | B1 | 11/2004 | Cutmore et al. | |

FOREIGN PATENT DOCUMENTS

| | | | |
|---|---|---|---|
| CA | 2164910 | * | 6/1997 |

* cited by examiner

*Primary Examiner* — Eric Golightly
(74) *Attorney, Agent, or Firm* — Chernoff Vilhauer McClung & Stenzel LLP

(57) ABSTRACT

The invention relates to an equipment for removing deposits accumulated in electrolytic refining on the surface of an electrode, such as a cathode, said equipment including at least one element for stripping the deposits and at least one element for controlling the stripping element; said equipment includes at least one stripping element that is turnably movable in the vertical direction of the cathode, and the cathode can be bent owing to the contact with said stripping element. The invention also relates to a method realized by said equipment.

13 Claims, 1 Drawing Sheet

1
2
3
17
10
11
15
6
16
7
13P1
13
14
13P2
5
9
12
8
4
15
13
16
14
13P2
13P1

17
10
1
11
3
2
6
7
15
15
16
13
13
13P2
14
16
13P 1
13P1
14
5
4
13P2
9
8
12

EQUIPMENT AND METHOD FOR REMOVING DEPOSITS CREATED IN ELECTROLYTIC REFINING

CROSS REFERENCE TO RELATED APPLICATION

This is a national stage application filed under 35 USC 371 Based on International Application no. PTC/FI2004/000719 filed Nov. 26, 2004, and claims priority under 35 UCS 119 of Finnish Patent Application No. 20031752 filed Dec. 1, 2003.

BACKGROUND OF THE INVENTION

The invention relates to an equipment and method for removing deposits created in electrolytic refining from the surface of an electrode, such as a cathode.

In the production of many metals, such as copper, zinc or nickel, one of the principal steps in the manufacturing process is electrolysis, where the metal to be produced is precipitated, by means of electric current conducted to the electrolyte, on the surface of an electrode, i.e. a cathode. Usually a cathode is an object provided with a suspension bar left above the electrolyte surface for suspending the cathode in the electrolytic tank and for connecting it to the circuit, as well as a plate-like element, i.e. a mother plate, to be immersed in the electrolyte, on the surface of which mother plate the metal to be produced is deposited.

In modern industrial plants, the cathode plate is usually made of a different metal than the metal to be produced, and the two vertical edges of the cathode plate, or all three edges immersed in the electrolyte, are provided by electric insulation made of plastic, so that the metal deposited on the cathode plate surface is, at least on its two vertical sides, stripped as two separate plates. Metal production by means of permanent cathodes of the above described type, made of a different metal, is carried out so that the metal to be produced is stripped as plate-like elements from the surfaces of the permanent cathodes, and the permanent cathodes are continuously circulated between the electrolytic tanks and the stripping station. The electric insulation provided at the edges of the permanent cathodes is necessary particularly for detaching and processing the deposited metal.

The operation of the manufacturing process and the production of metal require that the metal to be produced is removed sufficiently often from the surface of the cathode plate. Typically the interval between removals is between one and seven days, and because the removal generally requires massive transfer of material and an interruption in the process, the interval between the removals is attempted to be made as long as possible. Therefore the metal deposits are nowadays usually fairly thick, generally clearly thicker than 5 millimeters.

Because the production volumes in plants producing copper, nickel and zinc are large, there are thousands and tens of thousands of cathode plates in the plants, and even the number of those cathode plates that daily enter the removal step is easily thousands or tens of thousands. Therefore mechanized and automated stripping machines are used for removing the metal to be produced from the surfaces of the permanent cathodes. Further, because the manufacturing expenses of permanent cathodes are high, a maximal extension of their lifetime is extremely important from the point of view of the plant. It is true that the insulation provided at the cathode edges can well be replaced, but also the extension of their lifetime is advantageous from the point of view of the plant. Consequently the most important features of the stripping machine are that the machine does neither damage the permanent cathodes nor the edge insulation thereof, and that the produced metal is reliably detached and that the stripping machine can be made to operate at a high speed.

From the patent U.S. Pat. No. 4,840,710 there is known a method for removing a deposit from the surface of a cathode plate. According to the invention, the deposit is removed from the cathode surface by bending the cathode at one point, for example by means of a hydraulic cylinder, and also by utilizing in the removal process a wedge-like element or blasting with pressurized air. The cathode is supported at its bottom edge and held in a vertical position during the bending operation. It is also known to use mechanical striking tools, such as hammers, in the removal of deposits. However, in addition to disturbing noise, the known methods also have other drawbacks, for example the fact that the whole deposit cannot be removed by one stroke.

The object of the present invention is to realize an improved equipment for removing metal deposits created in electrolytic refining from the surface of the cathode employed as the electrode, so that the strains directed to the cathode itself are avoided, and the stripping process of the deposit is speeded up.

SUMMARY OF THE INVENTION

Remarkable advantages are achieved by means of the arrangement according to the invention for removing deposits created in electrolytic refining from the cathode surface. According to the invention, the equipment for removing deposits includes at least one stripping element that is turnably movable in the vertical direction of the cathode, so that the cathode can be bent owing to the contact of said element. When touching the cathode, the stripping element is simultaneously turned around its point of support. The stripping element is turned around its point of support by means of a device actuated by a control device, such as a cylinder or a motor. The stripping element can turn around its point of support in both directions. The stripping element can be turned for example only to that extent that the desired bending motion is achieved, whereafter the stripping element is returned back to the initial position. The stripping element touches the cathode on the desired contact surface, so that a wave motion is created in the cathode, and the cathode is bent; as a consequence, the deposit is detached from the opposite side of the cathode. By affecting the cathode surface by means of a turnably movable stripping element according to the invention, the deposit is removed flexibly and without sudden motions directed to the cathode. According to the invention, the bending can also be started at a desired point of the cathode, and thus both the bending motion and the removal of the deposit can be made more efficient. The equipment according to the invention speeds up the removal of the deposit, and mechanical strain directed to the cathode is avoided.

According to an embodiment of the invention, the stripping element is provided with at least one slide element, such as roller, for facilitating the sliding of the stripping element during the contact. During the removal, the stripping element touches the cathode at the spot where deposit is located. According to an embodiment of the invention, the cathode is supported in at least one place by at least one support element during the removal of the deposit, which makes it easier to carry out the removal. According to a method of the invention, the cathode can be bent for example in only one direction. According to the method, the cathode can be bent first in one direction, and then in the opposite direction, so that the deposits accumulated on both sides of the cathode are detached.

BRIEF DESCRIPTION OF THE DRAWINGS

The invention is described in more detail below with reference to the appended drawings.

DETAILED DESCRIPTION

Figure 1:
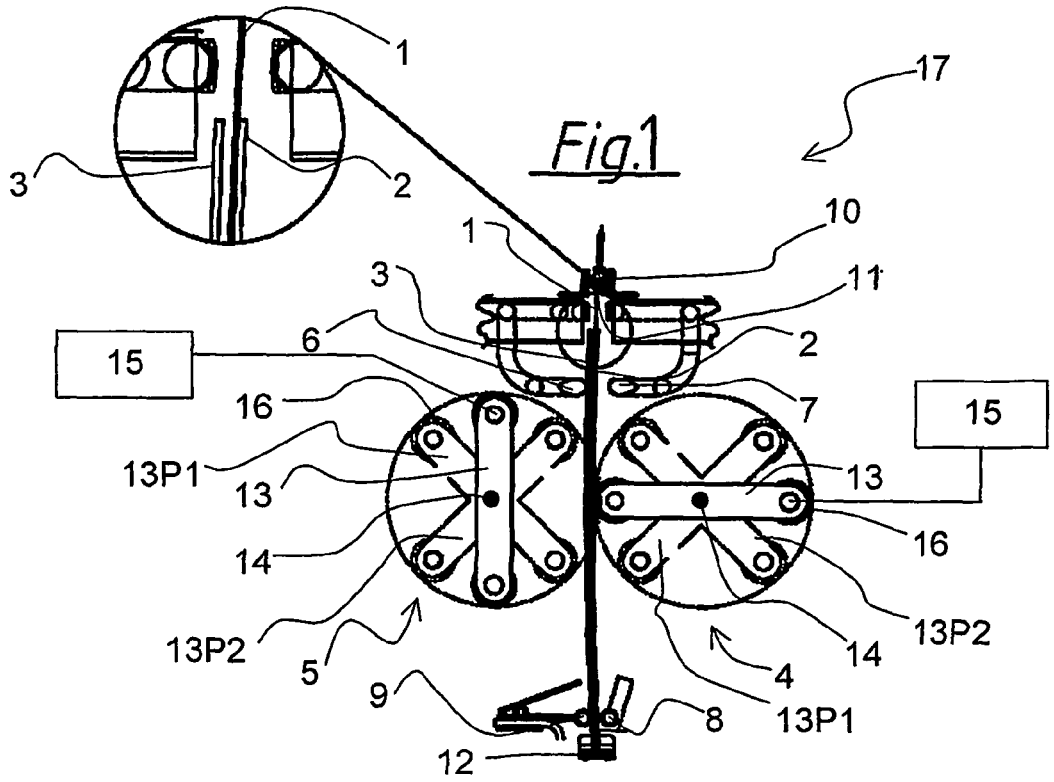
FIG. 1 Equipment according to the invention
Figure 2:
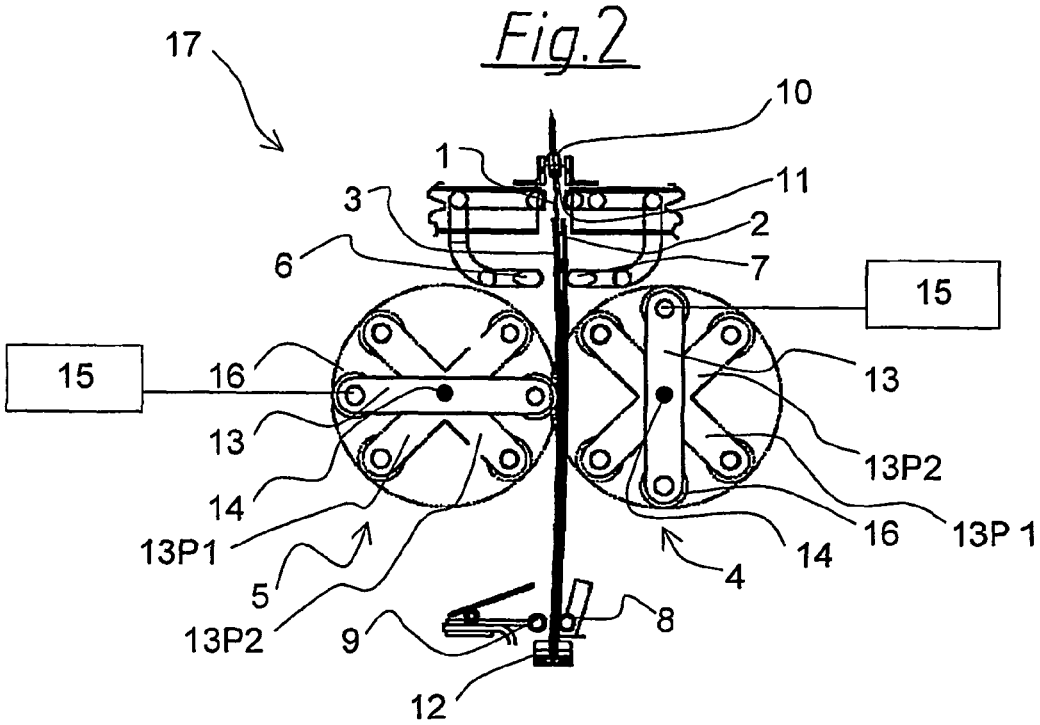
FIG. 2 Equipment according to the invention

FIGS. 1 and 2 illustrate the equipment for removing the deposits 2, 3 accumulated during electrolysis on the surface of an electrode, for example a cathode 1 made of stainless steel. According to the drawings, the cathode 1 is brought from electrolysis to the stripping station 17 for example by means of conveyors 12. According to the example, the cathode is supported at the support structure 10 of the stripping station in the vicinity of the suspension bar 11, i.e. at that end of the cathode that during the electrolytic refining process has been located above the electrolyte solution. Moreover, during the removal the cathode 1 is supported by means of support elements 6, 7, 8 and 9 provided in the stripping station, so that the cathode is in a vertical position during the removal of the deposit. By means of the support elements, the cathode can be supported either on both sides thereof, or only at the desired spot. For removing the deposits 2, 3, accumulated on both sides of the cathode 1 from the cathode surface, a stripping device 4, 5 is installed on both sides of the cathode. FIG. 1 illustrates how a deposit 3 is removed when the stripping device 4 is in operation, and respectively FIG. 2 illustrates how the deposit 2 is removed when the stripping device 5 is in operation.

The stripping device 4, 5 comprises a stripping element 13 that is turnably movable in the vertical direction of the cathode 1, so that the cathode can be bent owing to the contact with said stripping element. When the cathode is in a vertical position, that end of the cathode that is on the side of the suspension bar 11 is located above the stripping devices 4, 5. The references 13P1 and 13P2 illustrate the various positions of the stripping element 13. The circular pattern in FIGS. 1 and 2 describes the trajectory of the stripping elements 13, 13P1 and 13P2. The stripping element touches the cathode at a point where deposit is accumulated and simultaneously bends the cathode, so that the deposit is removed, due to the bending, from the opposite side of the cathode. The stripping element comprises at least one elongate element. The stripping element 13 has a point of support 14, around which the stripping element turns at the same time as it touches and bends the cathode. The contact surface in the cathode is defined according to how far the stripping element is turned around its point of support. The stripping element is capable of turning around its point of support 0-360 degrees in both directions. According to the example, the point of support is the center point of the stripping element. According to the example, the stripping element 13 turns first in its position 13P1 and then to its position 13P2. At both ends of the stripping element 13, there is connected a slide element 16, such as roller, to facilitate the sliding of the stripping element along the cathode surface during the stripping operation. If the stripping element turns a whole revolution around its support point 14, the rollers provided at the opposite ends of the stripping element can touch the cathode in turns.

The stripping element 13 is turned, by means of a control element 15 connected to the stripping element, around the point of support 14. The control element 15 can be for example a slewing cylinder, a hydraulic cylinder, a motored control device or any corresponding control element connected to the stripping element 13. By means of the control element 15, the stripping element 13 is made to turn around the point of support 14 either so that it rotates a full revolution around the point of support, or only for example less than 90 degrees, whereafter it returns to the initial position. The stripping element 13 is installed in the immediate vicinity of the cathode, so that when turning the stripping element around the point of support, the stripping element hits the cathode surface at a desired spot. The cathode is bent only to the extent that suffices to detach the deposit from the opposite side, but so that the bending does not result in the breaking of the cathode.

According to the invention, the cathode is first bent in one direction (FIG. 1) and then in the opposite direction (FIG. 2), so that the deposits 2, 3 accumulated on both sides of the cathode are detached. In the width direction of the cathode, the stripping element 13 extends at least along part of the cathode width, advantageously along the majority of the cathode width. The equipment according to the invention can also be used for partial removal of the deposit, in which case the final removal is carried out by a separate mechanism, such as a stripping tool.

For a man skilled in the art it is obvious that the various embodiments of the invention are not restricted to the above described examples only, but may vary within the scope of the appended claims.

The invention claimed is:

1. Apparatus for removing a metal deposit accumulated in electrolytic refining on a surface of a cathode, comprising:

a support structure for supporting the cathode substantially stationarily in a generally vertical orientation, at least one element for restraining a lower edge of the cathode against horizontal movement, and at least one element for restraining an upper edge of the cathode against horizontal movement, at least one stripping element that is turnable about a horizontal axis spaced from the cathode, the stripping element having an end that is spaced from the horizontal axis and moves vertically relative to the cathode during turning of the stripping element and engages the deposit on the surface of the cathode intermediate the lower and upper edges of the cathode and a control element coupled drivingly to the stripping element for turning the stripping element, whereby cooperation of the stripping element and the elements for restraining the lower and upper edges of the cathode against horizontal movement causes bending of the cathode.

2. Apparatus according to claim 1, wherein the stripping element includes a sliding element at the end of the stripping element for engaging the surface of the cathode.

3. Apparatus according to claim 2, wherein the sliding element is a roller.

4. Apparatus according to claim 1, wherein the support structure includes elements for restraining the lower edge of the cathode against horizontal movement in two opposite directions perpendicular to the lower edge of the cathode and elements for restraining the upper edge of the cathode against horizontal movement in two opposite directions perpendicular to the upper edge of the cathode.

5. Apparatus according to claim 4, comprising first and second stripping elements for engaging opposite respective surfaces of the cathode, each stripping element having an end and being turnable about a horizontal axis that is spaced from the cathode and is substantially parallel to the upper and lower edges of the cathode.

6. Apparatus according to claim 5, wherein each stripping element is provided at its end with a sliding element.

7. Apparatus according to claim 6, wherein the sliding element is a roller.

8. Apparatus according to claim 1, wherein the control element is a cylinder.

9. Apparatus according to claim 1, wherein the control element is a motor.

10. A method of removing a metal deposit accumulated in electrolytic refining on a surface of a cathode, comprising:

supporting the cathode substantially stationarily in a generally vertical orientation, restraining upper and lower edges of the cathode against horizontal movement, providing at least one stripping element that is turnable about a horizontal axis spaced from the cathode, and turning the stripping element about the horizontal axis, whereby an end of the stripping element that is spaced from the horizontal axis engages the deposit on the surface of the cathode intermediate the lower and upper edges of the cathode and moves vertically relative to the cathode and causes bending of the cathode.

11. A method according to claim 10, wherein the metal deposit comprises copper and the cathode is stainless steel.

12. A method of refining metal, comprising:

depositing the metal electrolytically on a cathode, and removing the metal deposit from the cathode by a method comprising supporting the cathode substantially stationarily in a generally vertical orientation, restraining upper and lower edges of the cathode against horizontal movement, providing at least one stripping element that is turnable about a horizontal axis spaced from the cathode, and turning the stripping element about the horizontal axis, whereby an end of the stripping element that is spaced from the horizontal axis engages the deposit on the surface of the cathode intermediate the lower and upper edges of the cathode and moves vertically relative to the cathode and causes bending of the cathode.

13. A method according to claim 12, wherein the metal deposit comprises copper and the cathode is stainless steel.

* * * * *